US006457761B1

(12) United States Patent
Benoit

(10) Patent No.: US 6,457,761 B1
(45) Date of Patent: Oct. 1, 2002

(54) DETACHABLE ROTATABLE GRAPPLE

(75) Inventor: Raymond L. Benoit, Hay River (CA)

(73) Assignee: Grapple Works, Inc., Port Moody (CA)

( * ) Notice: Subject to any disclaimer, the term of this patent is extended or adjusted under 35 U.S.C. 154(b) by 0 days.

(21) Appl. No.: 09/659,304

(22) Filed: Sep. 12, 2000

(51) Int. Cl.[7] ..... B66C 3/16; B66C 13/08
(52) U.S. Cl. ..... 294/86.41; 294/88; 294/106
(58) Field of Search ..... 294/86.4, 86.41, 294/87.1, 88, 68.23, 103.1, 104, 106, 119.4; 384/91, 300, 420, 425, 426, 445, 590, 908; 414/729, 732, 738, 739

(56) References Cited

U.S. PATENT DOCUMENTS 3,527,495 A * 9/1970 Maradyn ..... 294/86.41 X
3,631,995 A * 1/1972 Jones et al. ..... 294/86.41 X
3,651,966 A * 3/1972 Willett ..... 294/86.41 X
4,005,894 A * 2/1977 Tucek ..... 294/86.41 X
4,099,761 A * 7/1978 Cullings ..... 294/119.4 X
4,474,495 A * 10/1984 Ledwell ..... 294/86.41 X
5,073,080 A * 12/1991 Blum ..... 294/86.41 X
5,328,223 A * 7/1994 Maggio ..... 294/86.41
5,330,242 A * 7/1994 Lucky ..... 294/86.41 X

* cited by examiner

*Primary Examiner*—Johnny D. Cherry
(74) *Attorney, Agent, or Firm*—Graybeal Jackson Haley LLP

(57) ABSTRACT

A grapple for releasable attachment to a manipulator arm of a vehicle. The grapple unit comprises a central framework to which are pivotally mounted a pair of spaced, opposed gripping fingers to define a grasping region between the fingers. The fingers are movable to open and close the grasping region in order to grasp an object within the region. There is a joint assembly adapted to rotatably mount the central framework to the manipulator arm that includes a first planar bearing surface releasably connectable to the manipulator arm and a second planar bearing surface formed on the central framework and extending parallel to the first planar bearing surface. A sheet of low friction material is inserted between the parallel bearing surfaces to engage both surfaces. A shaft intersects the bearing surfaces to define an axis for rotation of the central framework with respect to the first planar bearing surface. A drive system is provided for controlling rotation of the central framework with respect to the first planar bearing surface. The grapple is simply and inexpensively constructed, and permits reliable grasping, lifting and rotation of objects.

13 Claims, 6 Drawing Sheets

DETACHABLE ROTATABLE GRAPPLE

FIELD OF THE INVENTION

This invention relates to grapple for releasable attachment to the manipulating arm of a vehicle.

BACKGROUND OF THE INVENTION

Vehicles for lifting and moving heavy objects are well known. Such vehicles, which include tractors, lifters and loaders, generally rely on hydraulically operated manipulator arms to which a tool is releasably attached. The tool can include equipment such as buckets, scraping blades, grapples or any other attachment capable of manipulating a desired object.

Of particular interest are grapples which generally include pivoting fingers to grasp and hold objects. Grapples are particularly useful for working with cylindrical objects such as drums, large paper rolls, logs, or pipes of various diameters. Examples of prior art grapple tools are disclosed in the following patents:

U.S. Pat. No. 3,038,620 to Collin

U.S. Pat. No. 3,527,495 to Maradyn et al.

U.S. Pat. No. 5,118,248 to Brucher

U.S. Pat. No. 5,536,133 to Velez et al.

A desirable feature of grapples, particularly when working with rolls or drums, is the ability to re-orient the grapple when grasping an object so that the object can be rotated. It is desirable to be able to rotate grasped cylindrical drums or rolls about their longitudinal axis through 90 degrees to rotate them from their planar ends to their cylindrical sides or through 180 degrees to flip them end for end. Preferably, the grapple can rotate through 360 degrees to allow the operator to select either clockwise or counterclockwise rotation of an object for maximum efficiency of manipulation.

The grapples disclosed in the above patents all use various mechanisms to rotate the grasping fingers and the held object. The equipment tends to rely on complex gearing and bearing mechanisms that involve many parts and are expensive to manufacture.

SUMMARY OF THE INVENTION

I have developed a novel grapple unit of simple construction that is capable of reliably grasping, lifting and re-orienting objects through 360 degrees or less.

Accordingly, the present invention provides a grapple for releasable attachment to a manipulator arm of a vehicle comprising:

a central framework;

a pair of spaced, opposed gripping fingers pivotally connected to the central framework to define a grasping region between the fingers, the fingers being movable to open and close the grasping region;

a joint assembly adapted to rotatably mount the central framework to the manipulator arm comprising a first planar bearing surface releasably connectable to the manipulator arm, a second planar bearing surface formed on the central framework and extending parallel to the first planar bearing surface, a sheet of low friction material inserted between the parallel bearing surfaces and engaging both surfaces, and a shaft intersecting the bearing surfaces to define an axis for rotation of the central framework with respect to the first planar bearing surface; and a drive mechanism for controlling rotation of the central framework with respect to the first planar bearing surface.

The grapple of the present invention employs a unique joint assembly that is designed to spread loading over the surface of the sheet of low friction material.

The grapple of the present invention is particularly useful for moving and stacking barrels and drums, and handling of pipes, poles, logs, branches and miscellaneous debris. It is useful for manipulating large, heavy objects.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
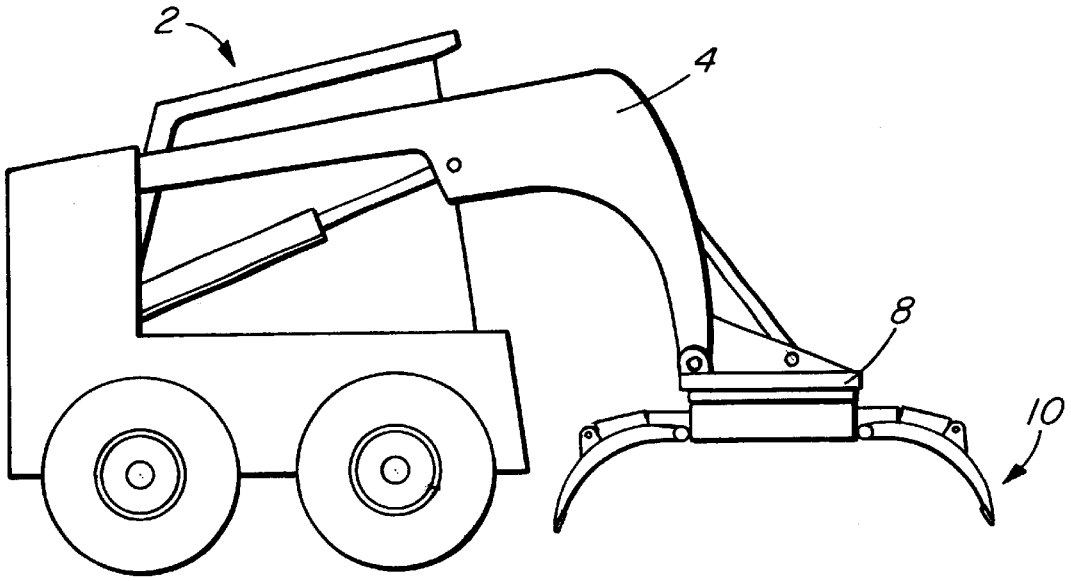
FIG. 1 shows the grapple of the present invention attached to a skid-steer loader.

Referring to FIG. 1, there is shown a skid-steer loader 2 having hydraulically operated manipulator arms 4 to which a grapple 10 according to a preferred embodiment of the present invention is attached. Grapple 10 is attached via a conventional releasable hitch attachment 8 used with this type of skid-steer loader. Skid-steer loader 2 is shown merely by way of example to illustrate the type of equipment to which grapple 10 can be attached. Grapple 10 is attachable to any equipment that includes a tool attachment bracket to which the grapple 10 can be mounted via an appropriate adapter.

Figure 3:
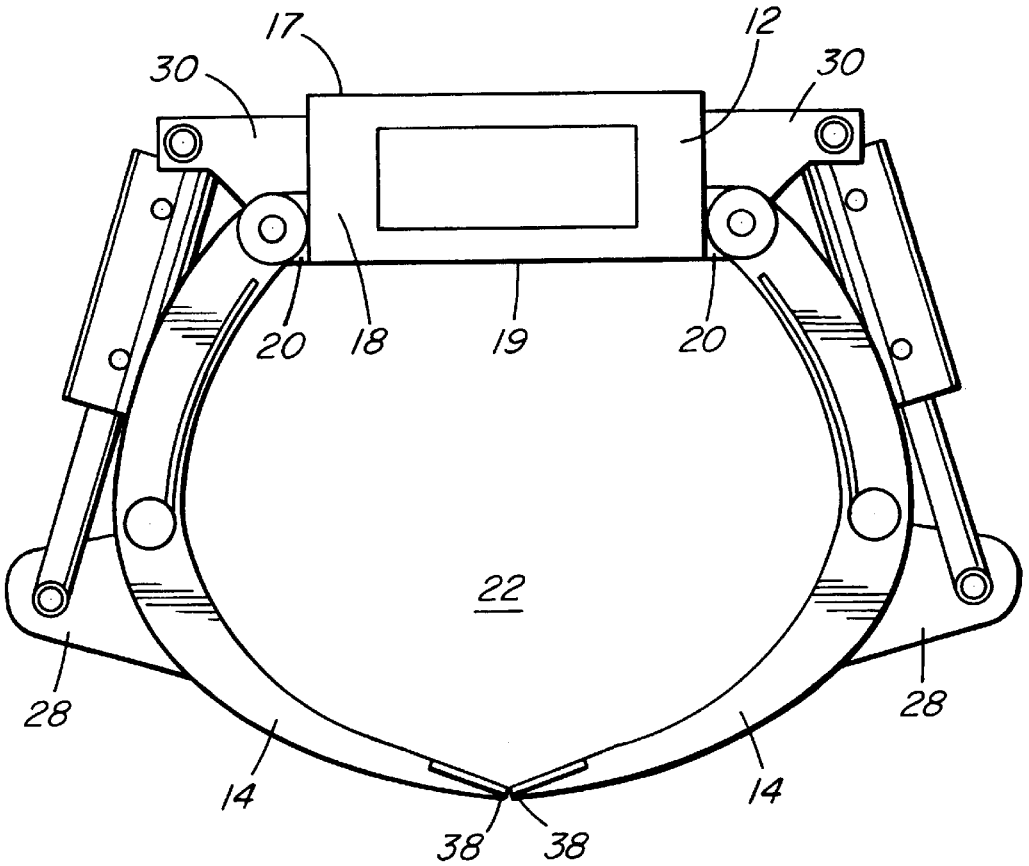
FIG. 3 is a detail view of the grapple with the pivoting fingers in the closed position.
Figure 2:
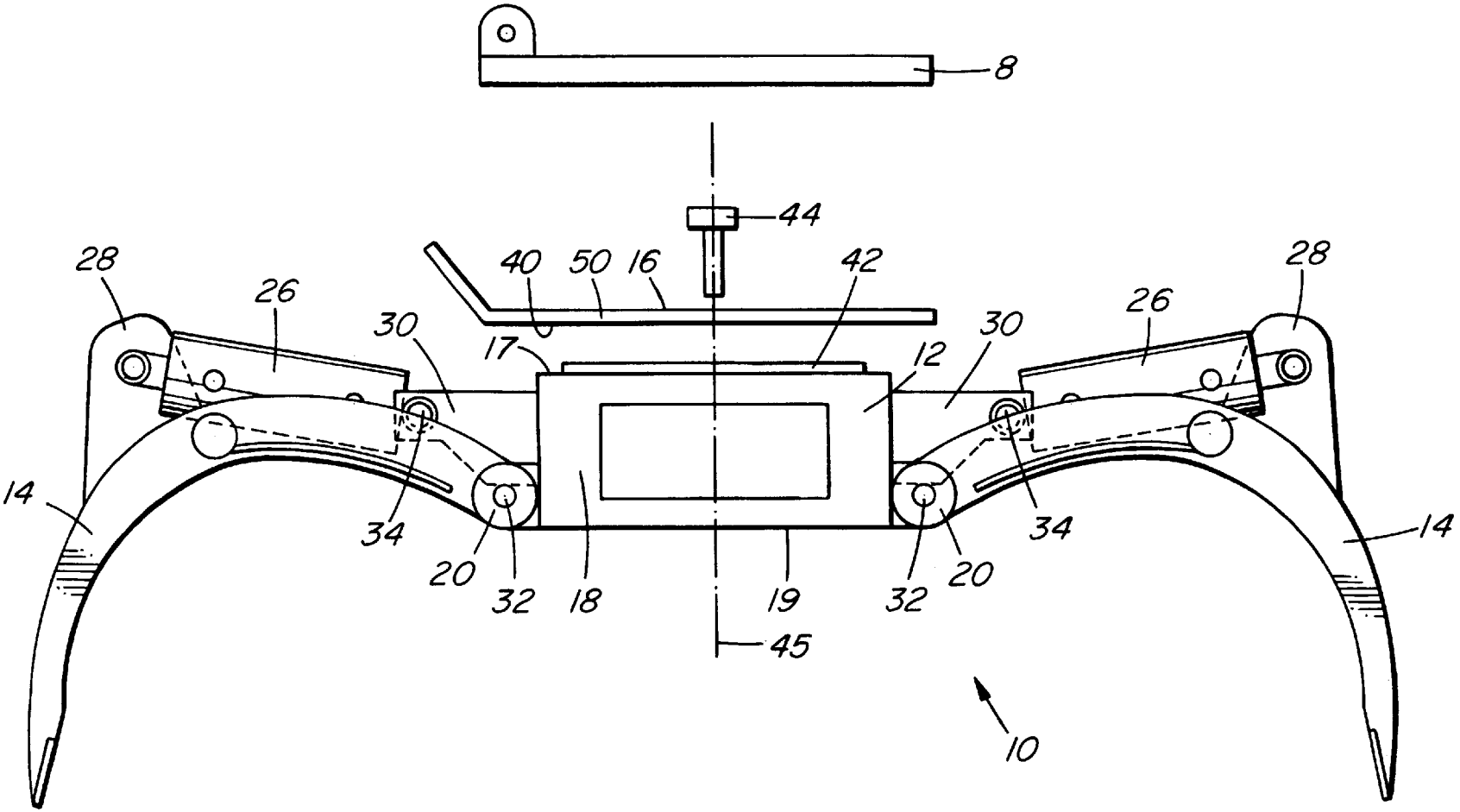
FIG. 2 is a detail view of the grapple with the pivoting fingers in the open position.
Figure 4:
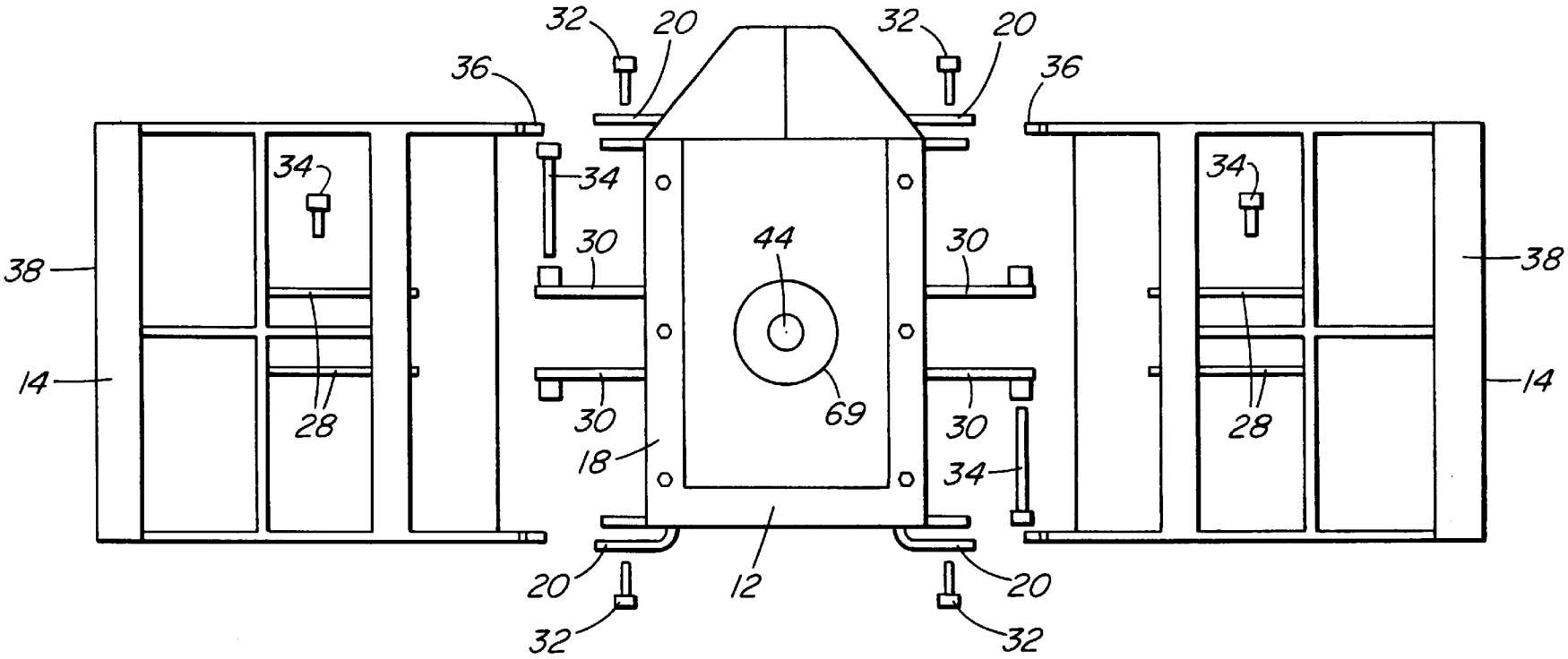
FIG. 4 is an exploded view showing the manner of attachment of the pivoting fingers to the central framework.

FIGS. 2 to 4 are detail views of grapple 10 of the present invention. The grapple unit comprises a central framework 12 to which are pivotally mounted a pair of spaced, opposed gripping fingers 14. Framework 12 is preferably a box construction 18 having a joint assembly 16 at a rear face 17 of the box for connection of the grapple unit to the hitch attachment 8. The front face 19 of the box is formed with a plurality of hinge brackets 20 at each corner to pivotally support fingers 14.

Fingers 14 define a grasping region 22 in front of box face 19 as best shown in FIG. 3. The fingers are pivoted together to close and encircle the grasping region in order to grasp and hold an object or objects within the region. FIG. 2 shows the fingers pivoted to open the grasping region in order to release an object from the grip of the grapple unit.

Each gripping finger 14 is manipulated by an actuator. Preferably, the actuator is a hydraulic cylinder 26 having opposite ends that are pivotally mounted between finger brackets 28 and box brackets 30. Extension of cylinders 26 causes fingers 14 to move to close the grasping region 22

(FIG. 3) while retraction of cylinders 26 moves the fingers to open the grasping region (FIG. 2).

As best shown in FIG. 4, fingers 14 are easily dismounted from box 18 of the central framework to permit maintenance or replacement. It is simply a matter of releasing pins 32 at hinge brackets 20 and pins 34 at finger brackets 28 to release the fingers. Other pivotable mounting arrangements of fingers 14 to central framework 12 are possible and are known in the art. The illustrated mounting arrangement is preferred for its simplicity and reliability. In addition, different arms can be attached to the framework to suit the work to be done.

Each finger 14 is preferably an arcuate member that extends from a first edge 36 adapted to be connected to hinge brackets 20 to a second edge 38 defining the tip of the finger. The tips of the two opposed fingers are positionable to clamp an object therebetween so that the region between the finger tips is part of grasping region 22

Figure 6:
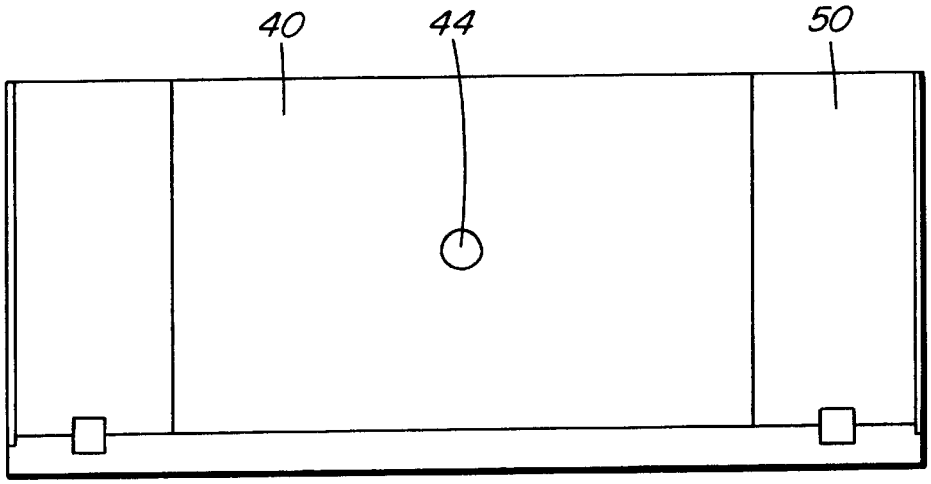
FIG. 6 is a detail view of the first bearing surface of the joint that is releasably attachable to excavating equipment.

The grapple unit of the present invention includes a joint assembly 16 to permit rotation and re-orientation of an object held by fingers 14. As best shown in FIG. 2, joint assembly 16 is adapted to mount central framework 12 to hitch attachment 8 to permit relative rotary movement. The joint 16 comprises a first planar bearing surface 40 that is releasably connectable to hitch attachment 8 in a conventional manner such that surface 40 is rigidly fixed with respect to the manipulator arm 4. For example, FIG. 6 shows a plate 50 formed with bearing surface 40 that is designed specifically to be releasably mountable to the hitch 8 of the skid steer vehicle of FIG. 1.

A second planar bearing surface is formed on central framework 12 to extend parallel to the first planar bearing surface 40. In the illustrated embodiment, this planar surface comprises the rear face 17 of box construction 18. A sheet of low friction material 42, preferably Teflon, is inserted between the parallel bearing surfaces 17,40 to engage both surfaces. A shaft 44 intersects the bearing surfaces through pre-formed aligned openings to define an axis 45 for rotation of central framework 12 with respect to first planar bearing surface 40. Preferably, shaft 44 is rigidly mounted at one end to first planar bearing surface 40 to protrude from surface 40 to receive central framework 12 and attached gripping fingers 14 for rotary movement.

Figure 7:
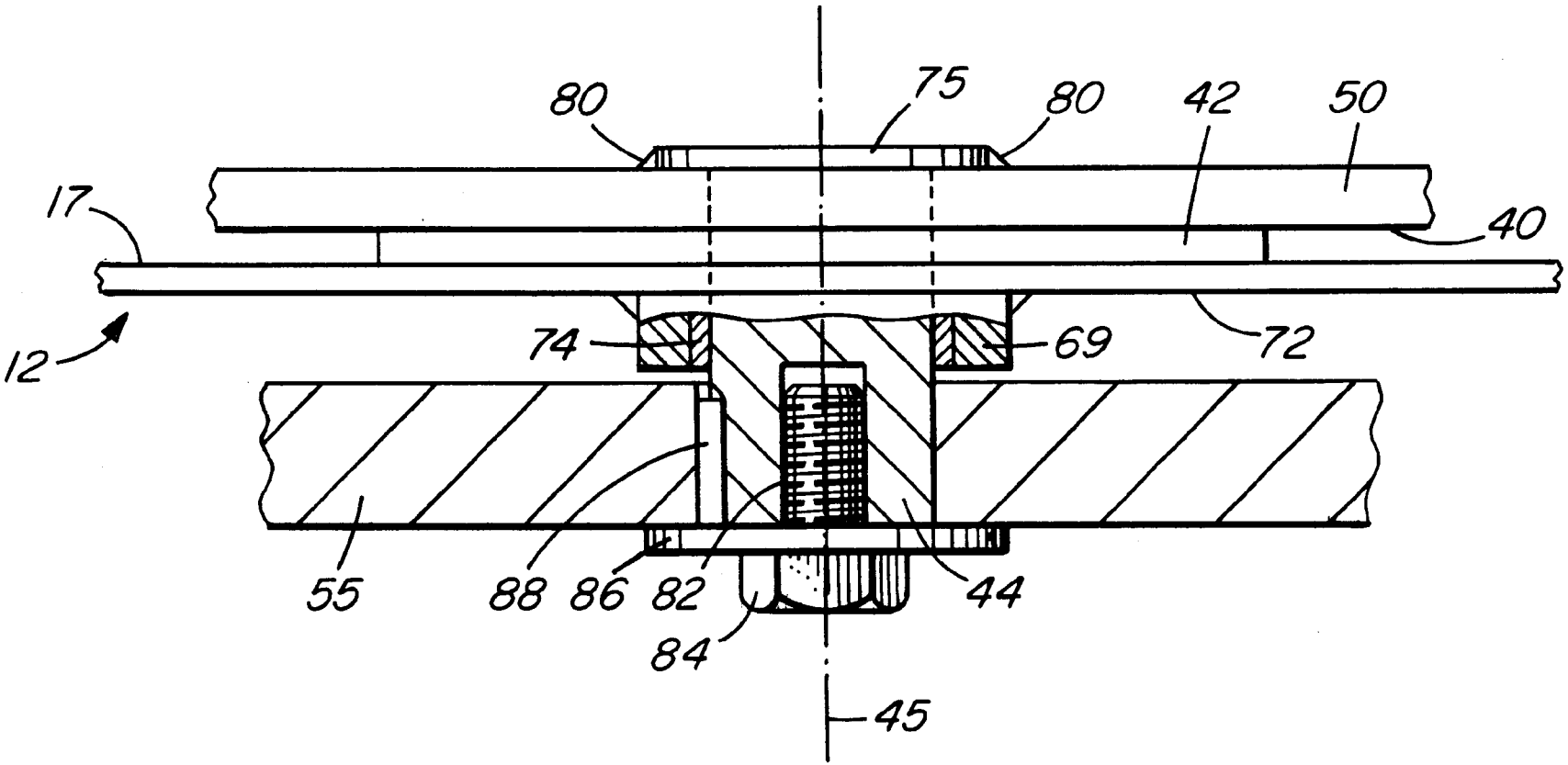
FIG. 7 is a section view showing details of a preferred arrangement for rotation of the grapple unit.

FIG. 7 is a detail section view showing a preferred manner in which the central framework 12 is supported on shaft 44 to ensure smooth rotation. An annular sleeve 69 is welded to the inner surface 72 of central framework 12 to house a bushing 74 to rotatably support shaft 44. The end shaft 44 is formed with a head 75 that is rigidly fixed preferably by welding 80 to plate 50. The opposite end of shaft 44 is formed with a co-axial threaded cavity 82 adapted to threadably receive a bolt 84 and washer 86. Bolt 84 and washer 86 are used to retain gear 55 on shaft 44. Keys 88 are insertable between the hub of gear 55 and shaft 44 to lock the gear to the shaft. The illustrated arrangement rigidly interconnects plate 50, shaft 44 and gear 55. Central framework 12, sleeve 69 and bushing 74 rotate about shaft 44 in response to actuation of a drive mechanism of which gear 55 is a part. The operation of the drive mechanism will be described in more detail below. Bushing 74 is provided to ensure smooth rotation of the central framework 12 about shaft 44. Low friction material 42 between bearing surface 40 of plate 50 and surface 17 of central framework 12 also acts to reduce friction forces and spread any loading over the area of the low friction material to reduce loads at shaft 44.

Figure 5:
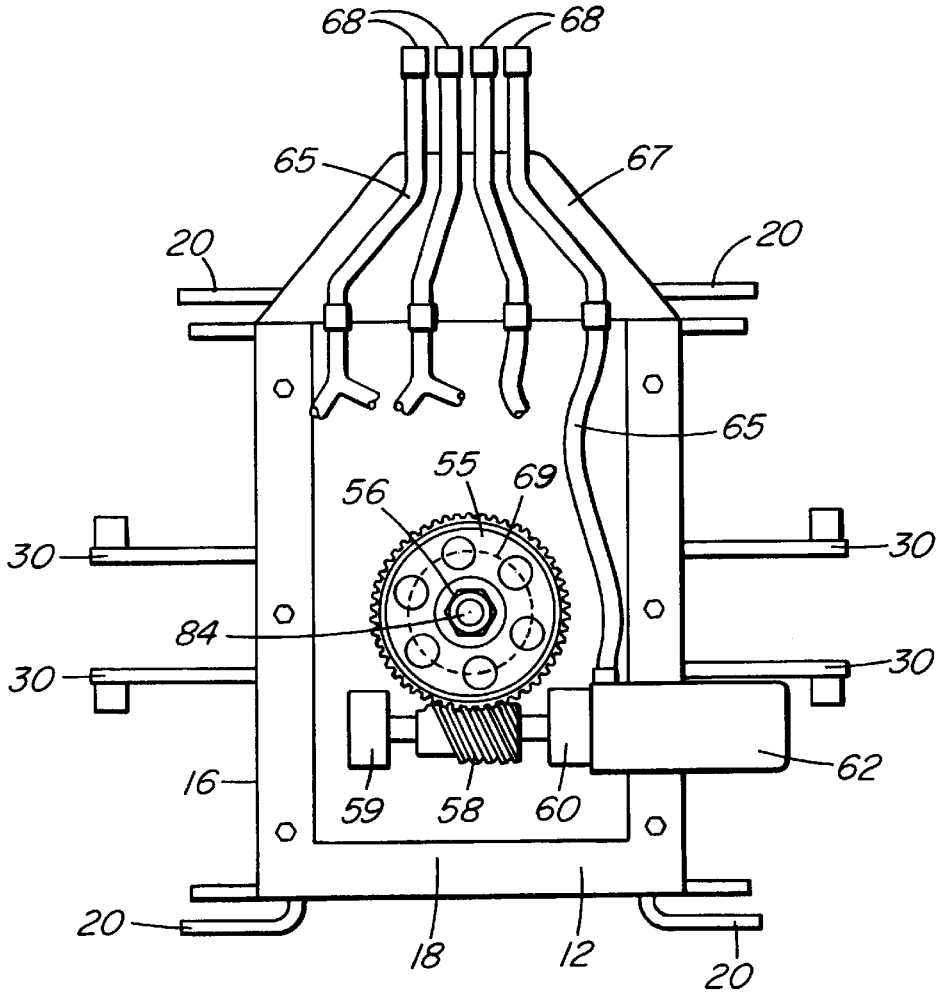
FIG. 5 is detail view of the interior of the central framework showing the rotary drive mechanism.

FIG. 5 shows a preferred drive arrangement positioned within the interior of box 18 to control rotation of the central framework 12 with respect to the first planar bearing surface 40. Box construction 18 normally includes a cover that defines surface 19; however, in FIGS. 4 and 5 this cover has been removed. In the illustrated embodiment of FIG. 5, the drive mechanism comprises rotary gear 55 that is non-rotatably mounted to shaft 44. The drive mechanism also includes a worm gear 58 mounted to the central framework by bearing blocks 59 and 60. Worm gear 58 meshes with rotary gear 55 and is driven by motor 62 which is preferably a hydraulic motor. Rotation of worm gear 58 causes central framework 12 to rotate about shaft 44. Operation of the drive mechanism is therefore controlled by operation of hydraulic motor 62.

In operation, the load on shaft 44 of rotatable central framework 12 with attached gripping fingers 14 and any object grasped by the fingers is supported to some extent by bushing 74 on shaft 44 within box 18; however, the majority of the load is borne by bearing surfaces 17 and 40. Preferably, bearing surfaces 17 and 40 and intermediate low friction sheet 42 are formed using as large a surface area as possible so that the load will be spread over a large area.

The grapple of the present invention is intended to be quickly connectable to the manipulator arms of a vehicle via plate 50. The various actuators and motors of the grapple are preferably hydraulically operated so that these components can be connected to the existing hydraulic pressure source of the vehicle. In this regard, as best shown in FIG. 5, box construction 18 is formed with a series of hydraulic hoses 65 that interconnect the various hydraulic components of the grapple. The hoses are preferably organized to extend from hood 67 at the top of box 18 so that they are readily accessible for fast connection to the existing hydraulic lines of the vehicle via terminal couplers 68. It will be appreciated by those skilled in the art that hoses 65 will be formed of sufficient length to accommodate rotation of central framework 12 through 360 degrees.

Figure 8:
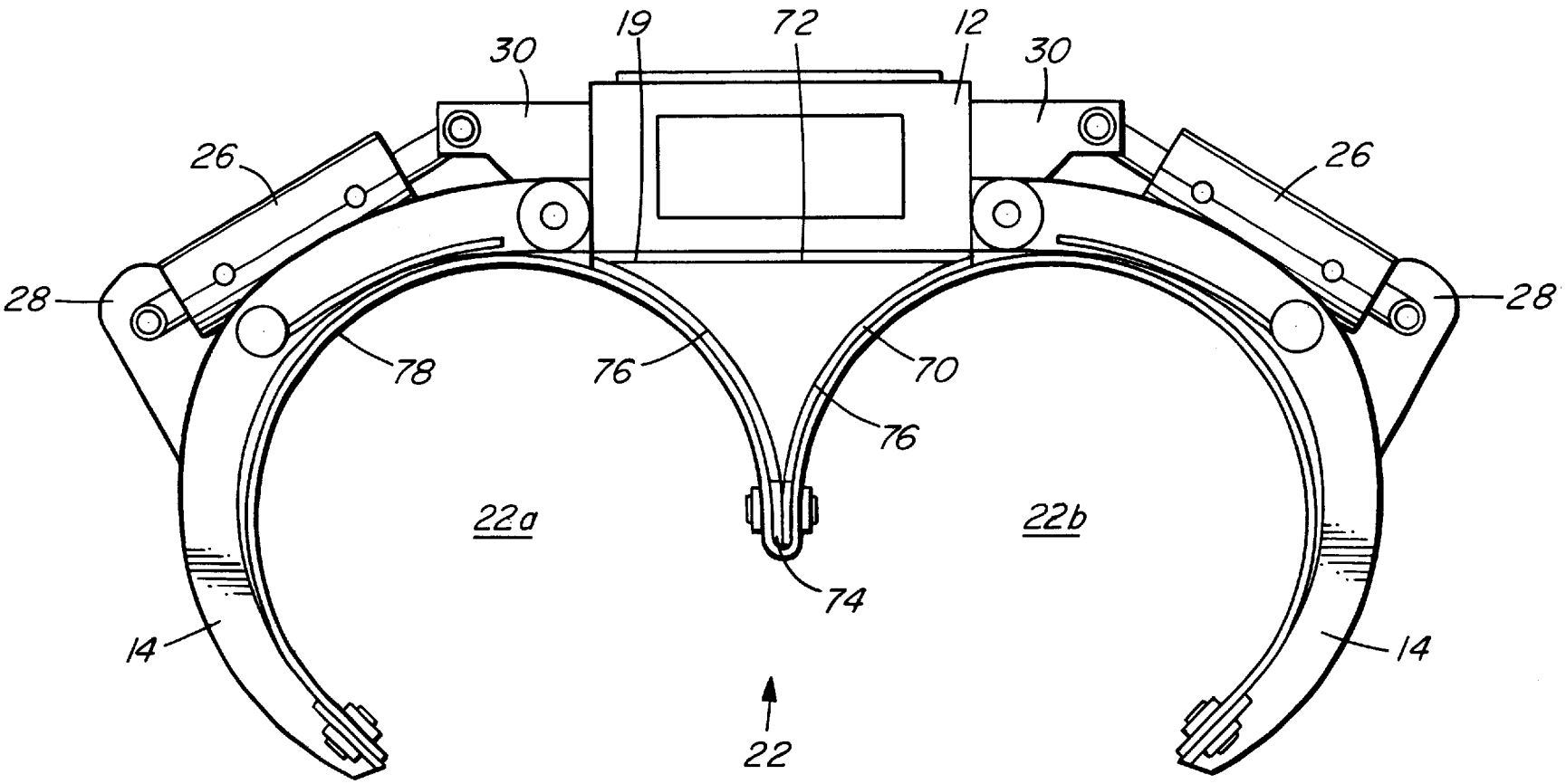
FIG. 8 is a view of the grapple fitted with an attachment to permit grasping and holding of two barrels.

FIG. 8 shows the grapple of the present invention fitted with a gripping attachment that makes the grapple particularly useful for simultaneously grasping two cylindrical objects such as rolls, barrels, or logs in the grasping region 22 between fingers 14. The attachment comprises a bracket 70 mountable to surface 19 of the central framework between the gripping fingers to divide grasping region 22 into two regions 22*a*, 22*b*. The bracket has a generally triangular cross-section in plan view with the base 72 of the triangle at surface 19 and the apex 74 extending into grasping region 22. The bracket extends the length of surface 19 to define arcuate walls 76 that are co-extensive with fingers 14. The fingers and walls 76 co-operate to define a pair of adjacent, arcuate surfaces of variable radius that partially enclose regions 22*a* and 22*b*. In use, fingers 14 are pivoted inwardly to substantially encircle and hold cylindrical objects located within regions 22*a* and 22*b*. Preferably, a resilient liner 78 made of rubber or the like is used to cover,the arcuate surfaces of the fingers and the walls 76 to ensure a reliable grip on the objects.

The grapple of the present invention enjoys the advantage of being simple in construction while being fully capable of performing the 360 degree rotary operation of much more complex prior art grapple units.

Although the present invention has been described in some detail by way of example for purposes of clarity and understanding, it will be apparent that certain changes and modifications may be practiced within the scope of the appended claims.

I claim:

1. A grapple for releasable attachment to a manipulator arm of a vehicle comprising:

a central framework;

a pair of spaced, opposed gripping fingers pivotally connected to the central framework to define a grasping region between the fingers, the fingers being movable to open and close the grasping region;

a joint assembly adapted to rotatably mount the central framework to the manipulator arm comprising a first planar bearing surface releasably connectable to the manipulator arm, a second planar bearing surface formed on the central framework and extending parallel to the first planar bearing surface, a sheet of low friction material inserted between the parallel bearing surfaces and engaging both surfaces, and a shaft intersecting the bearing surfaces to define an axis for rotation of the central framework with respect to the first planar bearing surface; and a drive mechanism for controlling rotation of the central framework with respect to the first planar bearing surface.

2. A grapple as claimed in claim 1 in which the first bearing surface includes means for releasably connecting the surface to the manipulator arm.

3. A grapple as claimed in claim 1 in which the shaft is fixedly mounted to the first planar bearing surface and rotatably supports the central framework.

4. A grapple as claimed in claim 1 in which the central framework includes an enclosure housing the drive mechanism.

5. A grapple as claimed in claim 1 in which the drive mechanism comprises:

a rotary gear fixedly mounted to the shaft;

a worm gear mounted to the central framework for engagement with the rotary gear;

a motor to rotate the worm gear whereby the central framework is rotated about the rotary gear.

6. A grapple as claimed in claim 5 in which the motor to rotate the worm gear is a hydraulic motor.

7. A grapple as claimed in claim 1 in which the sheet of low friction material is formed from polytetrafluoroethelyne.

8. A grapple as claimed in claim 1 in which each of the gripping fingers is pivotally connected to the central framework by a plurality of hinge joints, and an actuator extends between each finger and the central framework to move the finger.

9. A grapple as claimed in claim 8 in which the actuator is a hydraulic cylinder.

10. A grapple as claimed in claim 8 in which each gripping finger is an arcuate member that extends from a first edge adapted to be connected to the hinge joints to a second edge defining the tip of the finger, the tips of the two opposed fingers being positionable to clamp an object therebetween.

11. A grapple as claimed in claim 1 including a gripping attachment to simultaneously hold two cylindrical objects in the grasping region between the fingers.

12. A grapple as claimed in claim 11 in which the gripping attachment comprises:

a bracket mountable to the central framework between the gripping fingers to divide the grasping region into two regions, the bracket extending co-extensively with the fingers to define a pair of adjacent, arcuate surfaces of variable radius to substantially encircle and hold the cylindrical objects when the gripping fingers are moved to close the grasping region.

13. A grapple as claimed in claim 12 including a resilient liner to cover the arcuate surfaces.

* * * * *